US006418700B1

(12) United States Patent
Parcels

(10) Patent No.: US 6,418,700 B1
(45) Date of Patent: Jul. 16, 2002

(54) AUTOMATIC TANDEM CORNER PROTECTOR ATTACHMENT METHOD AND APPARATUS FOR PICTURE FRAMES AND THE LIKE

(76) Inventor: Joseph S. Parcels, 5537 Crest De Ville, Orange, CA (US) 92687

( * ) Notice: Subject to any disclaimer, the term of this patent is extended or adjusted under 35 U.S.C. 154(b) by 0 days.

(21) Appl. No.: 09/687,356

(22) Filed: Jan. 16, 2001

(51) Int. Cl.[7] ..... B65B 23/00
(52) U.S. Cl. ..... 53/410; 53/472; 53/139.7
(58) Field of Search ..... 53/410, 476, 74, 53/139.5, 139.6, 139.7; 206/586; 493/89

(56) References Cited

U.S. PATENT DOCUMENTS

| | | | | | |
|---|---|---|---|---|---|
| 3,585,780 | A | * | 6/1971 | Elmore | 53/139.3 |
| 3,725,170 | A | * | 4/1973 | Doll | 493/352 |
| 4,587,791 | A | * | 5/1986 | Brouse et al. | 53/139.3 |
| 4,598,825 | A | * | 7/1986 | Wiley et al. | 206/453 |
| 4,897,980 | A | * | 2/1990 | Geyser et al. | 53/139.3 |
| 6,018,934 | A | * | 2/2000 | Parcles | 53/472 |
| 6,089,434 | A | * | 7/2000 | Gleason | 227/152 |
| 6,164,512 | A | * | 12/2000 | Raffoni | 227/152 |

* cited by examiner

*Primary Examiner*—John Sipos
(74) *Attorney, Agent, or Firm*—William L. Chapin

(57) ABSTRACT

A method and apparatus for automatically installing in tandem pairs of protective covers to adjacent corners of a rectangular picture frame, to protect the corner during shipment, includes a pair, e.g., right and left of substantially identical corner protector installation mechanisms oriented at ninety degrees with respect to one another and mounted on a supporting frame laterally spaced apart at a distance adjustable to accommodate frames of various widths. Each mechanism has a work table which supports a pair of mutually perpendicular, non-intersecting, vertically disposed, longitudinally elongated guide plates which support on the upper surfaces thereof, near inner diagonally cut transverse vertical end walls of the plates, a clamp support beam member, a lower surface of which define with inner sides of the guide plates and the work table surface a diagonally disposed frame corner entrance opening. Sensors within each of the guide plates, near the inner ends thereof, provide a logic signal which indicates when both adjacent corners of a frame inserted horizontally into the apparatus have been fully inserted into and correctly oriented with respect to the guide plates, output signals from the sensors being logically ANDED to produce a command signal initiating simultaneous automatic operation of both mechanisms. Each mechanism includes a feeder mechanism which loads an individual, pre-cut cardboard preform into position on the work table inwardly of the opening through the guide plates. Also each mechanism includes folder mechanisms including flap folder arms which fit into workable recesses, and which bend a side cover flap and securement flap of a preform into a vertical position adjacent a first side of the frame corner and perpendicularly inwardly to overlie the first frame member, bend a spine flap and right-hand triangular cover flap of the preform into a vertical position adjacent the second frame member, and the right-hand triangular flap perpendicularly inwards from the spine flap to overlie the second and first frame members. An automatic staple gun then inserts a staple downwardly through the right-triangular cover flap into the securement flap and left-hand frame member, securing the corner protector in a folded disposition over the frame corner.

41 Claims, 14 Drawing Sheets

20B
10

20A
91
92
93
94
95
96
97
98
99
26R
227
100
226
32
24
33
226
25
23
227
266
30
36,37
34,35

101

AUTOMATIC TANDEM CORNER PROTECTOR ATTACHMENT METHOD AND APPARATUS FOR PICTURE FRAMES AND THE LIKE

BACKGROUND OF THE INVENTION

A. Field of the Invention

The present invention relates to methods and apparatus for protecting the corners of rectangularly-shaped frames, particularly picture frames, from impact damage during shipping. More particularly, the invention relates to a method and apparatus for attaching protective corners to two adjacent corners of a picture frame in tandem.

B. Description of Background Art

Picture frames for holding and displaying paintings, photographs, diplomas, certificates and similar flat articles are manufactured in prodigious quantities worldwide. Although picture frames vary in shape and construction details, most frames have a rectangular plan view shape. Moreover, the structure of most picture frames consists essentially of four straight channel members or moldings, each having an inner channel that intersects channels of adjacent members at a ninety degree angle. Four such channel members fastened together form a rectangular ring-shaped frame. The channels or recesses in the moldings comprise spaces for receiving a rectangularly-shaped flat display piece such as a photograph or painting, and sometimes, a backing panel, mat and protective cover glass.

Picture frames of the type described above are made from a variety of materials including, wood, metal and plastic. Whatever material the frame is made of, the geometry of a rectangular picture frame dictates that it have four peripheral members of generally uniform thickness which are joined at each other at forty-five degree mitre angles to form ninety-degree corners. These corners are sharp, and are therefore highly subject to breakage, denting or cosmetic damage during shipment. Accordingly, most picture frames, whether empty or occupied, are fitted with some sort of corner protectors during shipment. Such corner protectors are usually made of a relatively inexpensive recyclable material such as cardboard or polystyrene foam. Typical corner protectors of this type are disclosed in U.S. Pat. Nos. 3,955,677, 4,598,825, and 5,447,233. Other patents, related to protecting corners of objects during shipping include U.S. Pat. No. 4,407,898. Also, U.S. Pat. No. 5,255,458 discloses a three-dimensional picture corner and U.S. Pat. No. 4,787,553 discloses a corner fastening device.

In addition to the above-referenced patents related to corner protectors and the like, a variety of machines for bending sheet metal or cardboard of the type used for corner projectors have been disclosed in the following U.S. Pat. Nos.: 4,132,102, 4,585,432, 4,713,957, 4,857,038, 4,956,961, and 5,184,998.

None of the aforementioned references disclose a machine for automatically attaching corner protectors to picture frames. Accordingly, the task of attaching corner protectors to picture frames was formerly labor intensive and time consuming. In response to those limitations of the prior art, the present inventor disclosed an automatic Method and Apparatus For Attaching Corner Protectors to Picture Frames, in U.S. Pat. No. 6,018,934. In that patent, the present inventor disclosed a method and apparatus for installing covers to protect picture frame corners from damage during shipment, utilizing thin cardboard preforms having symmetric, left and right-hand, right-triangular cover flaps joined at vertical sides thereof to opposite vertical sides of a vertically elongated, rectangular spine flap, the left-hand triangular cover flap having depending downwardly from its base a horizontally elongated rectangular side cover flap, and depending downwardly from the lower lateral edge of the side cover flap a trapezoidally-shaped securement flap. The preform is positioned below a picture frame corner, with intersecting side members of the frame vertically aligned with the sides of the left-hand right-triangular cover flap, which serves as a lower face cover flap. The apparatus includes folder mechanisms including flap folder arms which are retractable into recesses provided in a work table, and which are extendible and rotatable to thereby bend the side cover flap and securement flap into a vertical position adjacent a first side of the frame corner and perpendicularly inwardly to overlie the first frame member, bend the spine flap and right-hand triangular cover flap into a vertical position adjacent the second frame member, and bend the right-hand triangular flap perpendicularly inwards from the spine flap to overlie the second and first frame members. An automatic staple gun then inserts a staple downwardly through the right-triangular cover flap into the securement flap and left-hand frame member, securing the corner protector in a folded disposition over the frame corner.

The present invention was conceived of to provide an automatic tandem corner protector attachment method and apparatus characterized by increased throughput rate, and a further enhanced degree of automation over the prior art.

OBJECT OF THE INVENTION

An object of the present invention is to provide a method for attaching in tandem a pair of protective covers to adjacent corners of a picture frame, to protect the corners from damage during transit.

Another object of the invention is to provide an apparatus for automatically attaching in tandem a pair of protective covers to adjacent corners of a picture frame.

Another object of the invention is to provide an apparatus for folding a pair of flat sheets of flexible material over two adjacent corners of a picture frame, and securing the folds of each sheet together to form a pair of separate protective covers, one for each of the two adjacent corners of the picture frame.

Another object of the invention is to provide an apparatus for bending a pair of flat cardboard preforms cut to a pre-determined shape over a pair of adjacent corners of a picture frame, and securing the folded portion of each cardboard preform to thereby form a pair of corner protectors for the picture frame.

Another object of the invention is to provide a picture frame corner protector attaching apparatus which includes means for clamping and holding a pair of adjacent corners of the frame, folding over each corner a separate one of a pair of preform sheets, each having the shape of a truncated isosceles triangle with a trapezoidally-shaped tab depending downwardly from one side of the base of the triangle, into three separate flaps which overlay each of the two corners of the frame, and securing the flaps of each preform sheet together and to a frame molding to form a pair of corner protectors covering the two corners of the frame.

Another object of the invention is to provide a picture frame corner protector attaching apparatus which includes a pair of adjustably spaced apart, mutually perpendicular holding jigs adapted to receive a pair of adjacent corners of picture frames of various sizes, the apparatus including sensor means associated with each of the two holding jigs to provide an index signal indicating that a picture frame corner has been fully inserted into a holding jig in a properly aligned disposition, and logic means responsive to the simultaneous presence of index signals from both holding jig sensors in producing a command signal to initiate attachment of a pair of corner protectors to the adjacent corners of the picture frame.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a method and apparatus for automatically installing in tandem pairs of protective cardboard covers to adjacent corners of rectangularly-shaped frames, particularly those used to hold pictures, documents and the like, the covers protecting the corners of the frame from damage during shipment.

The automatic tandem corner protector attachment method and apparatus according to the present invention preferably utilizes corner protectors made from thin sheets of cardboard, each pre-cut, by die cutting, for example, into a generally triangular shape which is modified to adapt the preform to be folded over and enclose a corner and adjacent portions of the side channel members of a conventional rectangularly-shaped picture frame. Four such corner protectors are used to cover the four corners of the frame. In a preferred embodiment of the invention, the overall plan view shape of the corner protector preform is that of two mirror symmetric, left and right, right-triangularly shaped flaps having collinear horizontal bases joined to opposite vertical sides of a vertically elongated rectangular spine flap. Thus shaped, the preform has the appearance of an isosceles triangle whose vertex is horizontally truncated. The preform preferably includes a horizontally elongated, rectangularly shaped lower cover flap which depends downwardly from the base of one of the right-triangle flaps, the left one, for example, and has the same width as the left triangular cover flap. A trapezoidally-shaped securement flap depends downwardly from the bottom edge of the lower cover flap, the securement flap having a lower edge wall parallel to but shorter than that of the lower cover flap. In a preferred embodiment, the horizontal width of the vertically elongated rectangular spine flap and the vertical height of the horizontally elongated lower cover flap have a common value which is slightly greater than the thickness of a picture frame which is to protected, e.g., about 15/16 inch for a frame thickness of 5/8 inch. Preferably, the vertical side walls of the vertical spine flap and the horizontally disposed upper and lower edges of the lower cover flap are scored to facilitate folding those respective flaps to contact adjacent perpendicular channel members or moldings of a picture frame.

According to the method of the present invention, a pair of preforms, score lines up, are positioned below two adjacent corners of a picture frame. Each of the two adjacent corners of the frame is oriented with respect to a preform with a pair of perpendicularly intersecting adjacent side walls defining a corner of the frame vertically aligned with the perpendicular sides of the left-hand right-triangular flap having the downwardly depending lower cover and securement flaps. The lower cover and securement flaps are then folded vertically upwards as a planar unit along the upper or inner score line defining the junction between the base of the left right-triangular cover flap and the lower cover flap. Next, the securement flap is folded downwardly and inwardly along the lower or outer score line towards a horizontal position contacting the upper surface of the frame member overlying the left triangularly-shaped cover flap. Then, the second, right-hand, right-triangularly-shaped cover flap and spine flap are bent upwards as a unit along the innermost vertical fold line, i.e., the left-hand vertical edge of the spine flap, to a vertical position. The right-hand triangular cover flap is then bent downwardly and inwardly along the outermost, right-hand vertical fold line of the spine flap to a horizontal position overlying and contacting the securement flap. Finally, the overlying right-hand triangular cover flap is fastened to the securement flap, by stapling, for example. In a preferred embodiment of the invention, using a wooden picture frame, a staple is driven through both the overlying right-hand triangular cover flap and the securement flap and into the underlying wooden frame member, thereby securing the corner protector to the frame.

With a preform attached to a corner of a picture frame as described above, the first, left-hand triangular cover flap covers a right triangular portion of the lower side of the frame corner, and the lower, rectangularly-shaped cover flap covers a portion of the outer, vertical side wall of a first side channel member of the frame, e.g., the "left-hand" side channel member. Also, the second, right-hand triangular cover flap covers a right triangular portion of the upper side of the frame cover overlying the lower triangular cover flap, while the spine flap covers a portion of the outer, vertical side wall of the second, "right-hand" side channel member.

The apparatus according to the present invention includes a base plate or work table having a flat upper surface for supporting a pair of adjacent corners of a picture frame, and a pair of frame holder clamping jigs for receiving and holding the adjacent corners of the picture frame on the surface of the table. In a preferred embodiment, the apparatus includes a pair of substantially identical corner protector installation mechanisms oriented at ninety degrees with respect to one another, each including a clamping jig and laterally movably mounted on a supporting frame. This construction allows the lateral spacing between the two clamping jigs to be adjusted to accommodate picture frames of various widths.

Each of the two tandem corner protector installation mechanisms includes a pair of corner protector flap folder actuators positioned on opposite sides of the corner of a picture frame held in the clamping jig. Each corner folder actuator includes a flat, rectangularly-shaped flap-contacting arm mounted near a longitudinal end thereof on the upper end of a post which is actuable by a linear actuator from a lower inactive position in which the arm resides within a rectangularly-shaped recess in the upper surface of the base plate, with the upper surface of the arm flush with the upper surface of the base plate, to an upper, active position. Each post also includes a 90-degree rotary actuator means, which is effective in rotating a flap contacting arm, when raised, from an outer position contacting the outer vertically disposed side of a flap to an inner position effective in exerting an inwardly and downwardly directed folding force on the flap.

In operation, the first corner folder actuator arm is extended vertically, folding the lower cover flap and securement flap upwardly into a vertical position adjacent one side of a frame. The arm is then rotated inwards, bending the securement flap inwardly and downwardly into contact with the upper surface of the first frame molding strip.

Next, the actuator arm of the second corner folder actuator is elevated, folding the upper triangular cover protector flap upwardly to a position vertically adjacent the outer edge of the second frame molding strip. The arm of the first corner folder actuator is then rotated outwardly from its position overlying and holding down the securement flap, while the arm of the second actuator is simultaneously rotated inwardly, bending the triangular flap down into contact with the securement flap. An automatic stapling machine then inserts a staple through the upper triangular flap, underlying securement flap, and underlying frame molding, thereby securing the corner protector to the frame. Both actuator arms are then automatically rotated and retracted to their recessed positions, flush with the work table surface. At the same time, the frame holding clamp is also automatically released, allowing the frame with attached corner protector to be removed from the clamp.

The apparatus according to the present invention includes means for automatically and substantially simultaneously initiating operation of two corner protector installation mechanisms of the type described above, each time two adjacent corners of a picture frame are fully inserted into and correctly oriented with respect to clamping jigs of the mechanisms. In a preferred embodiment, apparatus components for implementing this automatic operation include a pair of guide plates in each clamping jig that have inner vertically disposed wall surfaces that define therebetween a ninety degree intersection angle or vortex, which is cut off or truncated by a plane oriented at forty-five degrees to the guide bars, to thereby form an opening for insertably receiving the corner of picture frame, with the intersecting channel moldings of the frame aligned with the guide plates.

Each guide plate is provided, near the opening between the inner longitudinal ends of the guide plate, with a sensor which provides an electrical signal indicating that a frame corner molding has been fully inserted into the clamping jig. The electrical signal from each pair of sensors for each of the two clamping jigs are logically ANDed, producing a command signal to initiate automatic operation of the machine only when all three outer sides of the frame channel moldings defining two adjacent corners of the frame are fully inserted into and properly aligned with the guide plates of the two clamping jigs for proper operation of the corner protector folding and attaching operation. This command signal initiates a sequence of operations by which a pair of corner protectors are automatically attached in tandem to the two corners of a picture frame. Upon completion of this automatic operation, the holding clamps of both clamping jigs are automatically released, allowing the frame with a pair of attached corner protectors installed to be withdrawn from engagement with the apparatus. The frame may then be rotated one hundred and eighty degrees in a horizontal plane, and re-inserted into the apparatus to initiate attachment of a pair of corner protectors to the remaining two corners of the picture frame.

DESCRIPTION OF THE PREFERRED EMBODIMENTS

FIGS. 1–15 depict an automatic tandem corner protector attachment method and apparatus for picture frames and the like, according to the present invention. The structure and function of certain portions of the apparatus according to the present invention are described in detail in the present inventor's U.S. Pat. No. 6,018,934, the entire specification, claims, abstract and drawings of which are hereby incorporated by reference into the present specification. Accordingly, a complete understanding of the aforementioned structure and function of those portions may be obtained by reference to that patent.

Figure 1:
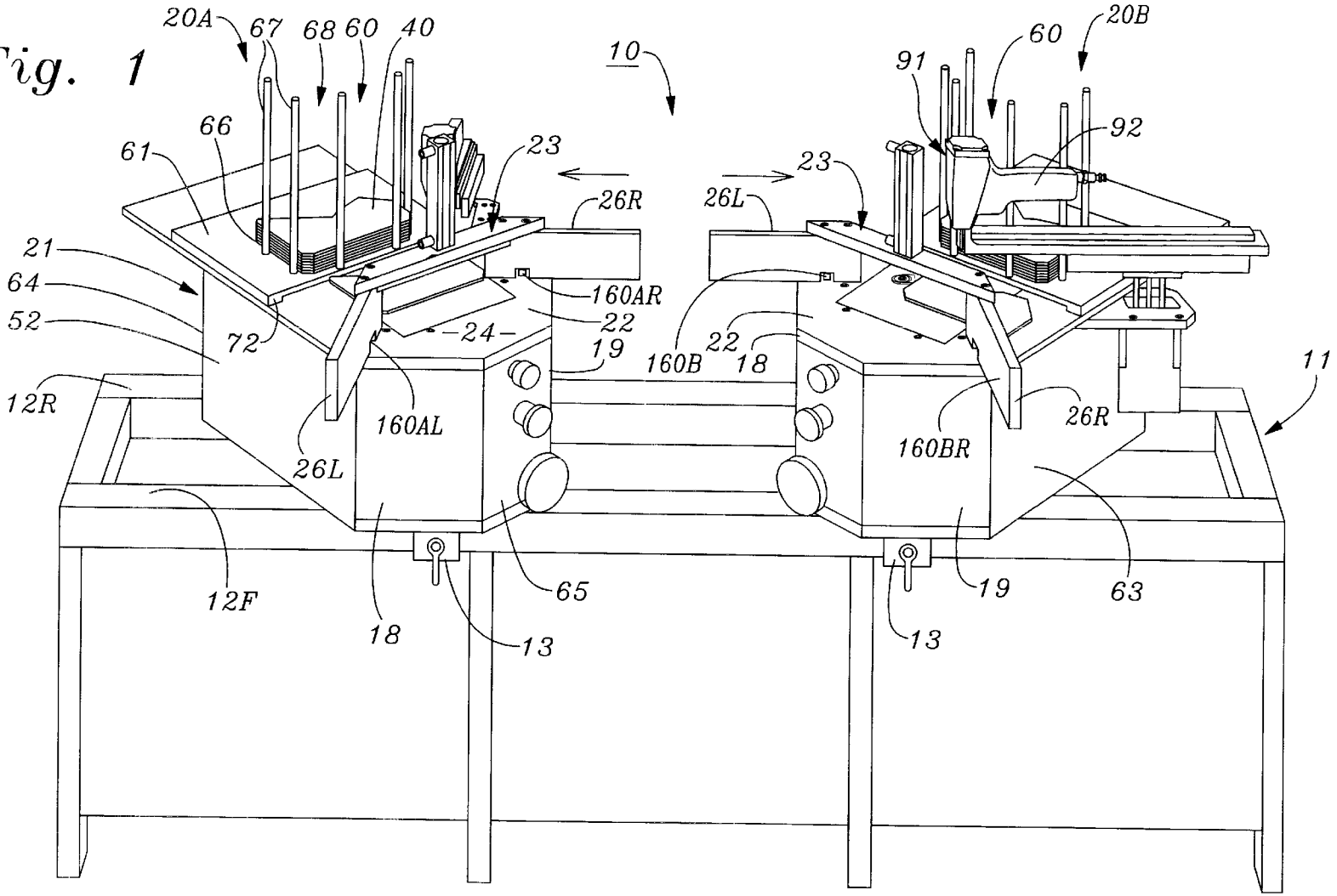
FIG. 1 is a front perspective view of an automatic tandem corner protector attachment apparatus for picture frames and the like according to the present invention.
Figure 2:
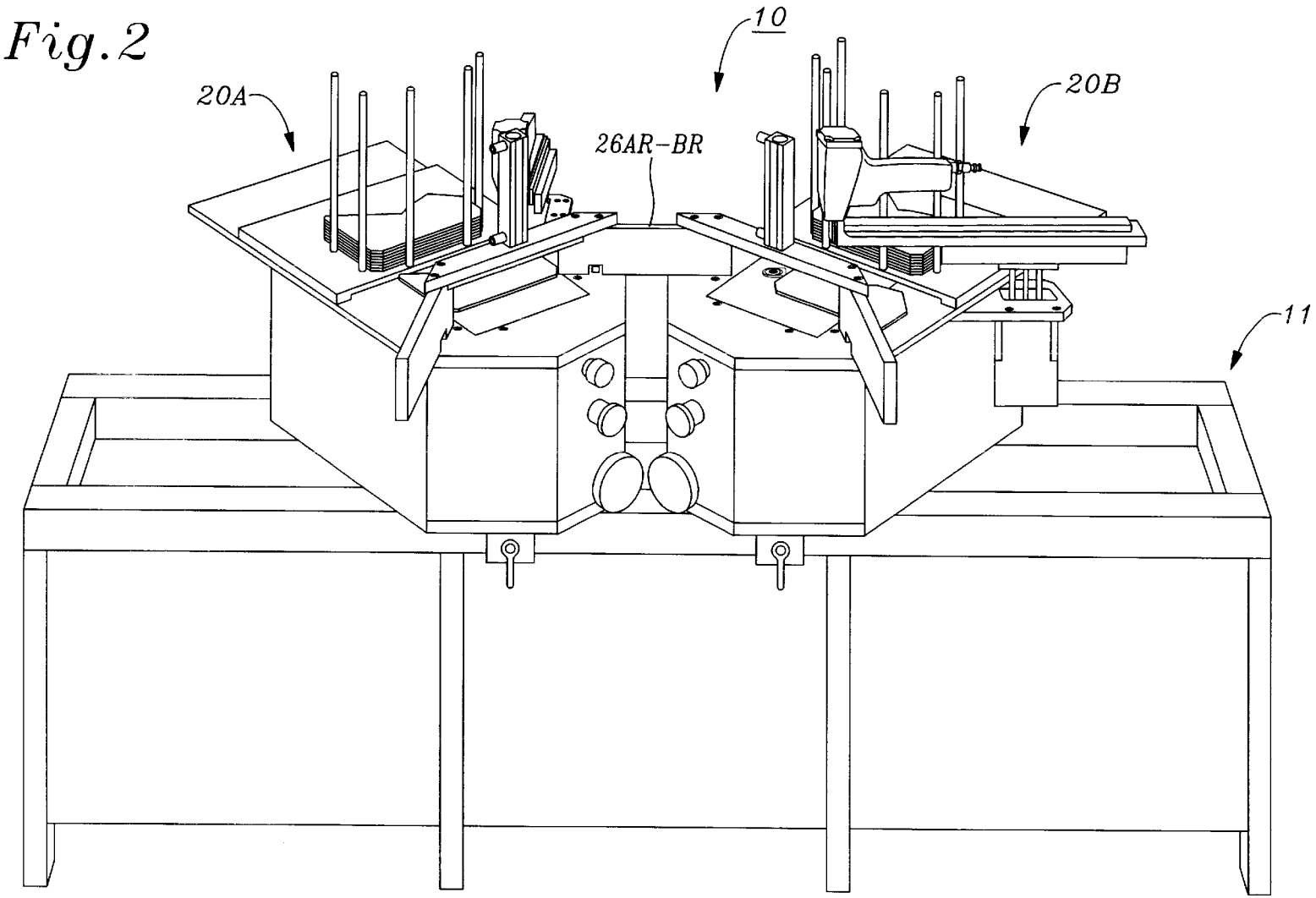
FIG. 2 is a view similar to that of FIG. 1, but showing a guide plate of one of two installation mechanisms of the apparatus removed, and the two mechanisms slid laterally together to accommodate narrower frames than those which the configuration of FIG. 1 is adapted to accommodate.

Referring now to FIGS. 1 and 2, an automatic tandem corner protector attachment apparatus 10 for picture frames according to the present invention may be seen to include a pair of substantially identical corner protector installation mechanisms 20, designated 20A, 20B, for convenience when necessary to distinguish between the two. Mechanisms 20A, 20B are each substantially similar in structure and function to the apparatus disclosed in U.S. Pat. No. 6,018,934. In apparatus 10 according to the present invention, mechanisms 20A and 20B are spaced laterally apart, with their respective horizontal longitudinal axes inclined at ninety degrees with respect to one another, and plus and minus forty-five degrees, respectively to a laterally disposed axis between the two mechanisms. As shown in FIGS. 1 and 2, installation mechanisms 20A and 20B are preferably laterally slidably mounted on a laterally elongated, rectangular box-shaped support frame 11. Thus, as shown in FIGS. 1 and 2, each installation mechanism 20A, 20B is slidably mounted on a plurality of laterally disposed, parallel, front and rear horizontal rails 12R, 12L forming part of support frame 11. Each mechanism is securable at a desired adjustable lateral position on front and rear rails 12F, 12R by clamps 13, e.g., toggle clamps.

As shown in FIGS. 1 and 2, each corner protector installation mechanism 20 includes a generally rectangular box-shaped enclosure 21 surmounted by a generally flat, upper base plate or work table 22. As may be seen best by referring to FIG. 1, apparatus 20 includes an elongated, generally straight frame holder/clamping jig 23 mounted on the upper surface 24 of work table 22. Preferably, clamping jig 23 is disposed obliquely, e.g., at 45 degrees, with respect to the rectangular plan-view shape of work table 22. As shown in FIGS. 1, 2, 5 and 8, clamping jig 23 is spaced above upper surface 24 of table 22, and includes an elongated, horizontally disposed upper straight beam member 25, supported at opposite lateral ends thereof by a pair of laterally opposed, left and right guide plates 26L, 26R, respectively. Guide plates 26 have flat and parallel lower and upper surfaces, 226 and 227, these surfaces supporting clamp beam member 25 so that its lower surface 27 is parallel to and spaced above upper surface 24 of work table 22.

Figure 4:
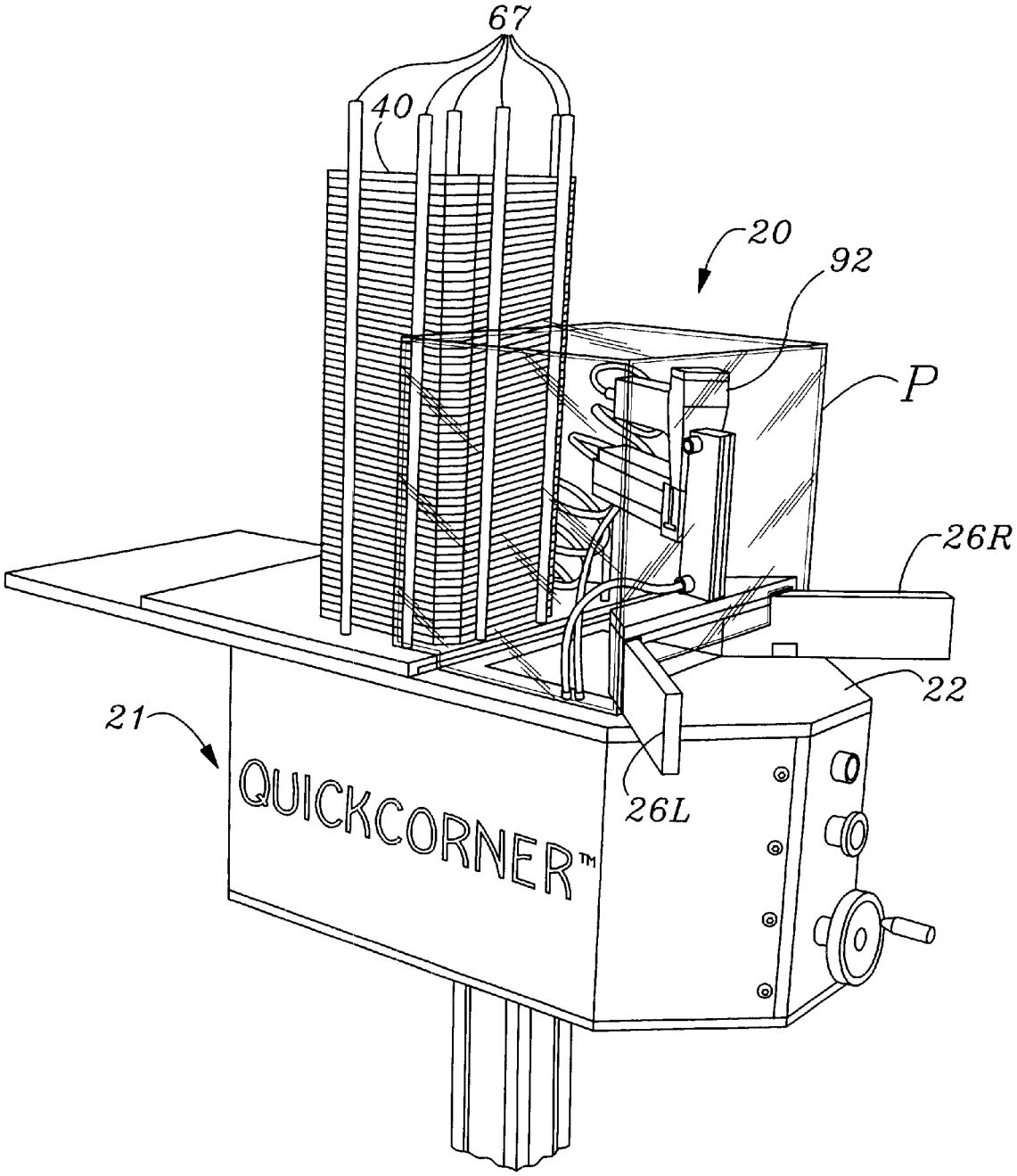
FIG. 4 is an upper perspective view of one of two tandem installation mechanisms comprising parts of the apparatus of FIG. 1, showing preforms loaded into a protective cover installed on the mechanism.
Figure 5:
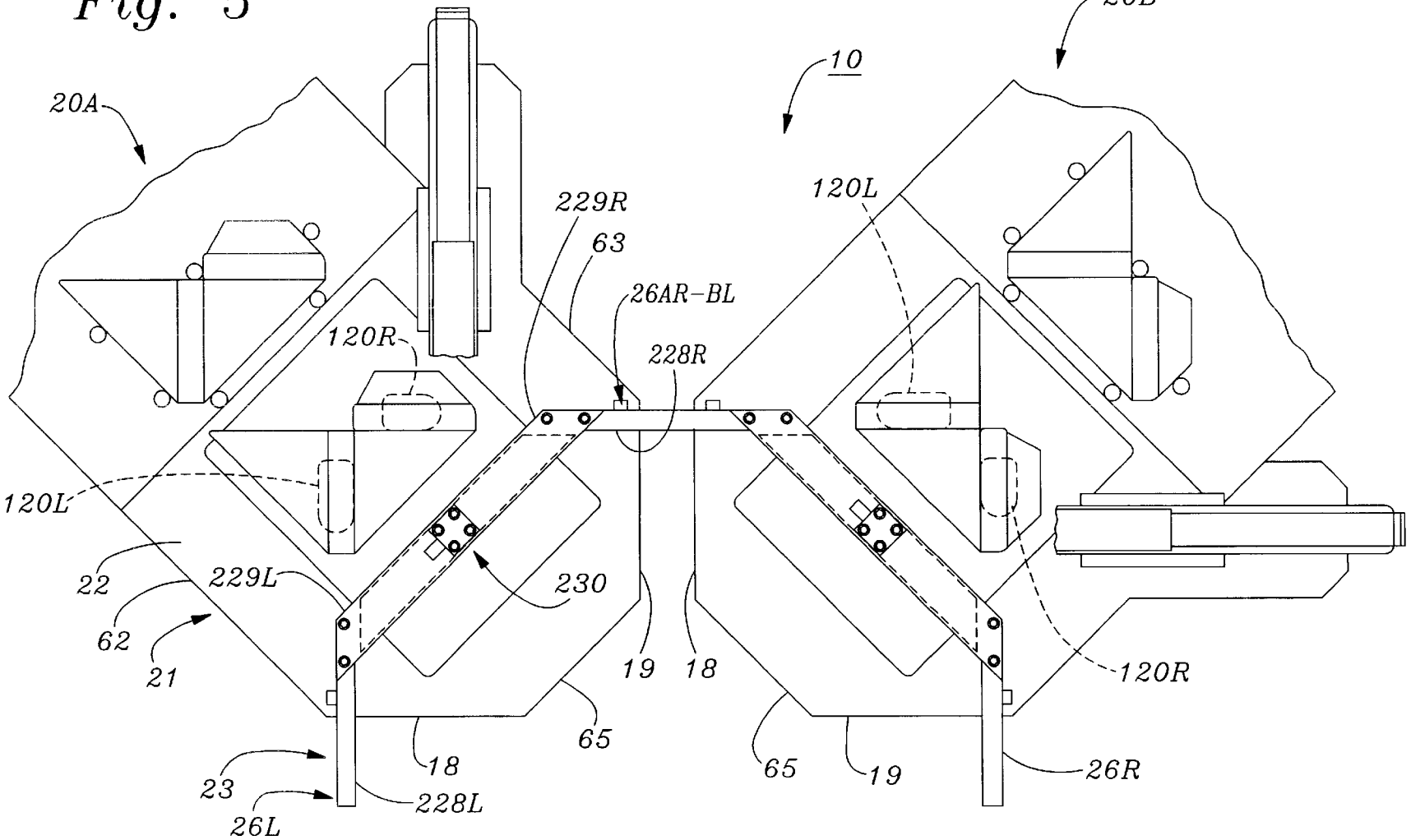
FIG. 5 is an upper plan view of the apparatus of FIG. 2, showing two corner protector preforms advanced to two separate clamping locations provided for two adjacent corners of a picture frame.

As shown in FIGS. 1, 4, and 5, enclosure 21 of each mechanism 20 has parallel, vertically disposed left and right side panels 62 and 63, which are perpendicular to front and rear vertically disposed panels 65, 64. Front panel 65 is joined to left and right side panels 62, 63 by left and right vertically disposed transition panels 18, 19. The latter are obliquely angled to front panel 65, e.g., at 45 degrees. This construction enables pairs of mechanisms 20 to be oriented with longitudinal axes of the mechanism, defined by a horizontal line centered in work table 22 and perpendicular to front panel 65, perpendicular to one another, with transition panels 19, 18 of mechanisms 20 spaced closely next to one another, as shown in FIG. 1, to accommodate narrow picture frames. The spacing between adjacent mechanisms 20A and 20B indicated in FIG. 5 can further be decreased to accommodate even narrower picture frames by reducing the length of guide plate 26AR–BL, which serves as a common right-hand guide plate 26R for mechanism 20A, and left-hand guide plate 36L for mechanism 20B, to a value which results in right transition panel 19 of left-hand mechanism 20A contacting left-hand transition panel 18 of right-hand mechanism 20B.

Figure 6:
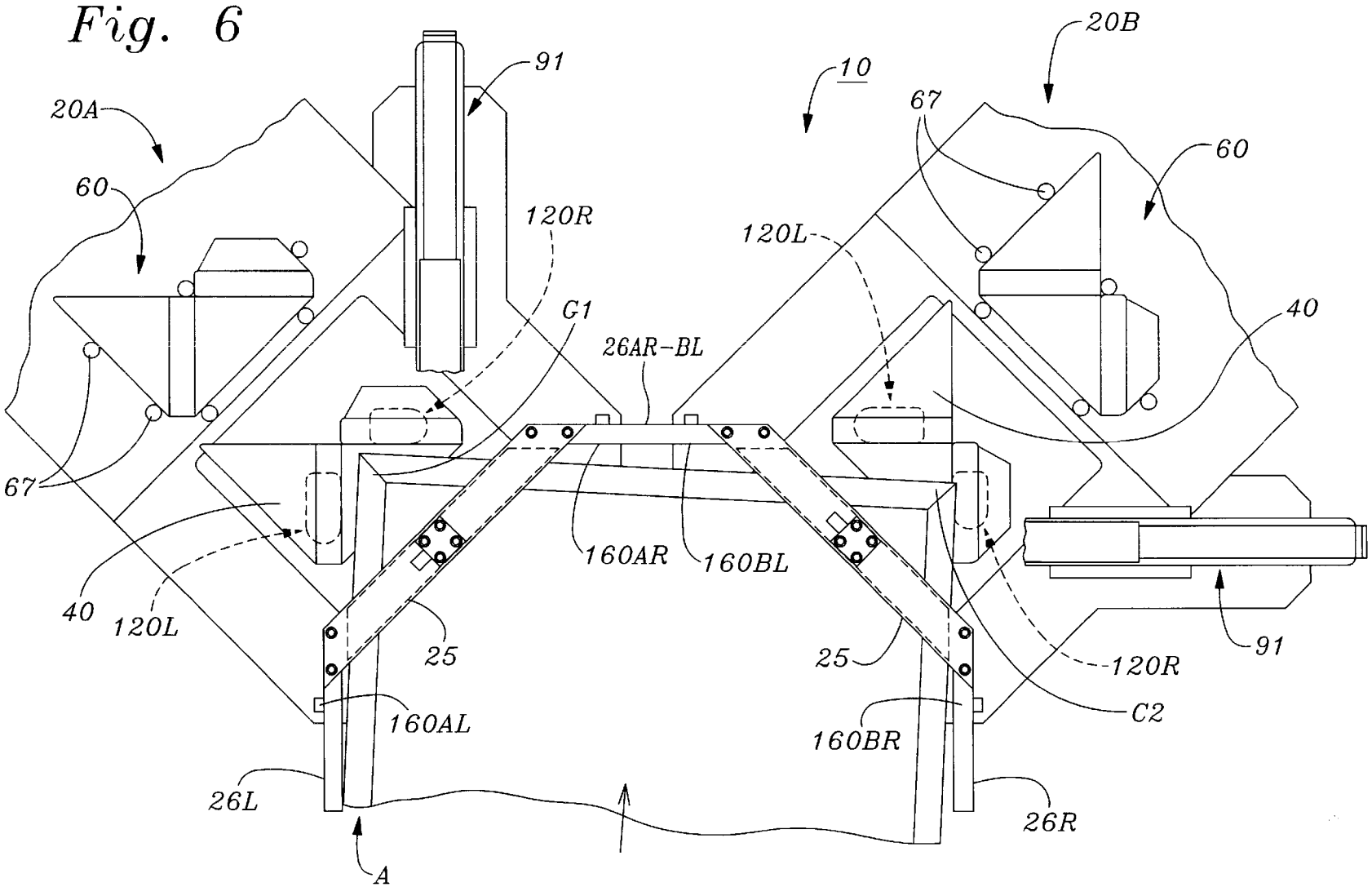
FIG. 6 is an upper plan view of the apparatus of FIG. 2, showing a picture frame inserted partially into the apparatus.

As shown in FIGS. 1 and 6, left and right guide plates 26L and 26R have inner longitudinally disposed vertical wall surfaces 228L and 228R, respectively. If extended inwardly or rearwardly towards the center of work table 22, inner vertical surfaces 228L and 228R of guide plates 26L and 26R would intersect to form a right angle corner. However, as shown in FIGS. 1–5, guide plates 26L and 26R are provided with obliquely disposed inner vertical transverse face walls 229L and 229R, respectively, that are coplanar, and angled at 45 degrees to inner vertical side walls 288L and 228R. Thus arranged, inner vertical side walls 228L and 228R form guide surfaces along which may be slid the outer side walls of side channel members of a rectangular picture frame that intersect each other at a ninety-degree corner. A laterally disposed space 230 between opposed inner corners 231L and 231R of guide plates 26L and 26R allows the corner of a picture frame to produce inwardly beyond inner face walls 229L and 229R of the guide plates.

As may be seen best by referring to FIGS. 1 and 8, clamping jig 23 includes a horizontally disposed, elongated straight clamp bar 28 located below and in vertical alignment with clamp beam member 25. Clamp bar 28 is vertically movably held with respect to clamp beam member 25. Thus, as shown in FIGS. 1 and 6, clamping jig 23 includes a linear actuator comprising a double acting pneumatic cylinder 30, for raising and lowering clamp bar 28. Clamp bar cylinder 30 is mounted on the upper surface 31 of clamping jig support beam 25, and has a piston rod 32 which protrudes vertically downwards in a bore 33 provided through the thickness dimension of the support beam. The lower end of piston rod 32 has a square transverse sectional shape which protrudes through a similarly shaped bore through clamp bar 28, and is secured to the clamp bar by a screw 29. Since pneumatic cylinder 30 is of the type in which piston rod 32 is non-rotatable, clamp bar 28 is maintained in a fixed horizontal orientation when moved vertically with respect to work table 22.

As shown in FIG. 1, clamp bar cylinder 30 has an upper pressurized "down" air inlet port 34 connected to a first "down" air inlet hose 35, and a second, lower, "up" air inlet port 36 connected to a second, "up" air inlet hose 37. Hoses 35 and 37 connect to tubular fittings 38 and 39 which protrude downwards through upper surface 24 of work table 22, to control valves and a source of pressurized air, as will be discussed in detail below. When pressurized air is supplied to "up" inlet port 36 of clamp air cylinder 30, pressurized air on the lower side of a piston within the cylinder forces the piston, attached piston rod 32, and attached clamp bar 28 upwards to an upper, unlocked position, as shown in FIG. 1. Conversely, when pressurized air is supplied to "down" inlet port 34 of clamp air cylinder 30, pressurized air on the upper side of the piston within the cylinder forces the piston and clamp bar 28 downwards to a lower position in clamping contact with a picture frame A, as shown in FIG. 8.

Figure 3:
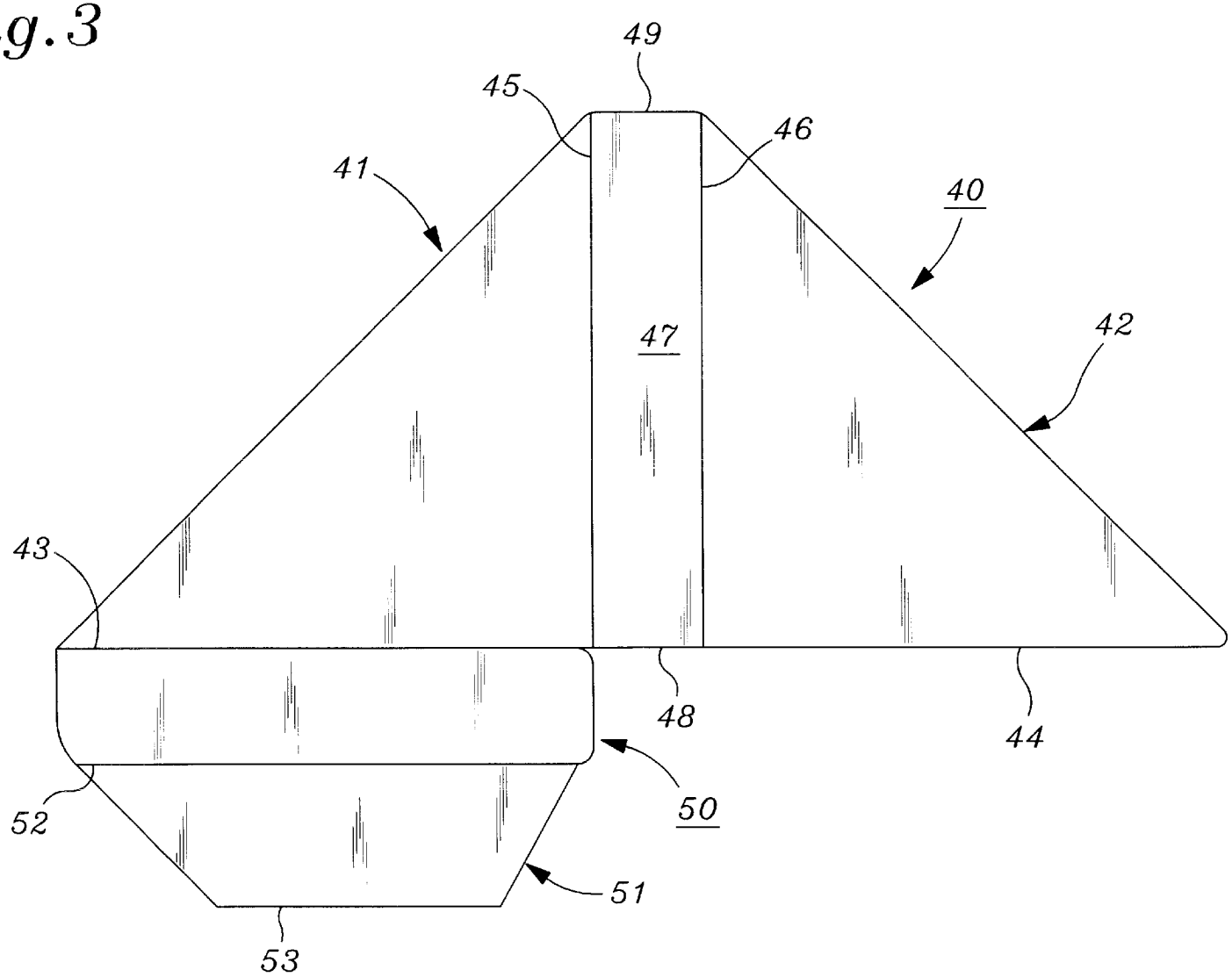
FIG. 3 is an upper plan view of a corner protector preform or blank usable with the apparatus of FIG. 1.

A preferred embodiment of mechanism 20 according to the present invention includes a feeder mechanism 60 for automatically feeding one corner protector preform 40 at a time to a pre-determined position beneath clamping bar 28 of clamping jig 23, prior to inserting a frame to be protected into the clamping jig. The structure and function of feeder mechanism 60 may be best understood by first reviewing the construction of corner protector preforms 40 used with apparatus 20. FIG. 3, shows a corner protector preform 40 of the type the apparatus 20 is intended to be used with.

As shown in FIG. 3, preform 40 is made of a thin sheet of readily bendable material, such as corrugated cardboard.

Preform 40 has two laterally mirror symmetric, right-triangular shaped flaps 41 and 42, respectively. In the orientation of preform 40 shown in FIG. 4, flap 41 is on the left-hand side of the figure, and will be referred to as the left-hand flap as a matter of convenience throughout the ensuing discussion. Left and right triangular flaps 41 and 42 have collinear horizontal bases 43 and 44 joined at their respective ninety degree corner angles to opposite vertical sides 45 and 46 of a vertically elongated rectangular spine flap 47, which has a base 48 collinear with the bases of the triangles. Thus shaped, preform 40 has an appearance approximating that of an isosceles triangle having a horizontal base 43-48-44 and an upper vertex truncated by a horizontal edge 49 parallel to the base.

Referring still to FIG. 3, preform 40 may be seen to include a horizontally elongated rectangularly shaped lower cover flap 50 which depends downwardly from base 43 of left-hand triangular flap 41, and has the same width as the flap. A trapezoidally-shaped securement flap 51 depends downwardly from the bottom edge wall 52 of lower rectangular cover flap 50, the securement flap having an upper edge wall coextensive with bottom edge wall 52 of the rectangular cover flap, and a lower edge wall 53 parallel to but shorter than edge wall 52.

In a preferred embodiment of corner protector preform 40, the width of spine flap 47 and the height of lower cover flap 50 are each equal to a common value which is slightly greater than the thickness of a typical picture frame, e.g., about 15/16 inch, for a frame thickness of 7/8 inch. As shown in FIG. 4, preform 40 is preferably scored along edge walls 45 and 46 of vertical spine flap 47, and along edge walls 43 and 52 of lower rectangular cover flap 50. These score lines are located along boundaries between adjacent flaps, and facilitate folding the flaps around a picture frame corner, as will be explained below.

Referring again to FIGS. 1 and 2, corner protector feeder mechanism 60 may be seen to include a longitudinally elongated, rectangularly shaped guide plate 61 having a generally flat upper surface mounted above and parallel to upper surface 24 of work table 22. Guide plate 61 is oriented with its long axis parallel to left and right side walls 62 and 63 of enclosure 21, and protrudes rearwardly beyond rear side wall 64 of the enclosure. As shown in FIGS. 1, 5 and 6, guide plate 61 of feeder mechanism 60 has through its thickness dimension a perforation 66 having substantially the same outline shape as corner protector preform 40. Guide plate 61 is spaced above upper surface 24 of table 22 by longitudinally disposed support ribs 72, at a distance slightly greater than the thickness of corner protector preform 40, e.g., 5/16 inch for preforms having a thickness of about 1/4 inch. Thus, a corner protector preform 40 placed conformally over perforation 66 will drop through the aperture onto work table surface 22, allowing the preform to be slid into operating position under clamping jig 23, as will be described in detail below.

In a preferred embodiment of apparatus 10, as shown in FIGS. 1 and 2, each corner protector installation mechanism 20 includes a plurality of vertically disposed guide rods 67 which protrude perpendicularly upwards from upper surface 24 of work table 22. Guide rods 67 define between tangents to the outer wall surfaces of inner facing sides of the rods a uniform transverse cross-section, vertically disposed bore 88 which is vertically aligned with guide plate perforation 66 and which is adapted to receive a vertical stack of preforms 40.

Figures 8A, 8B, 15A, 15B:
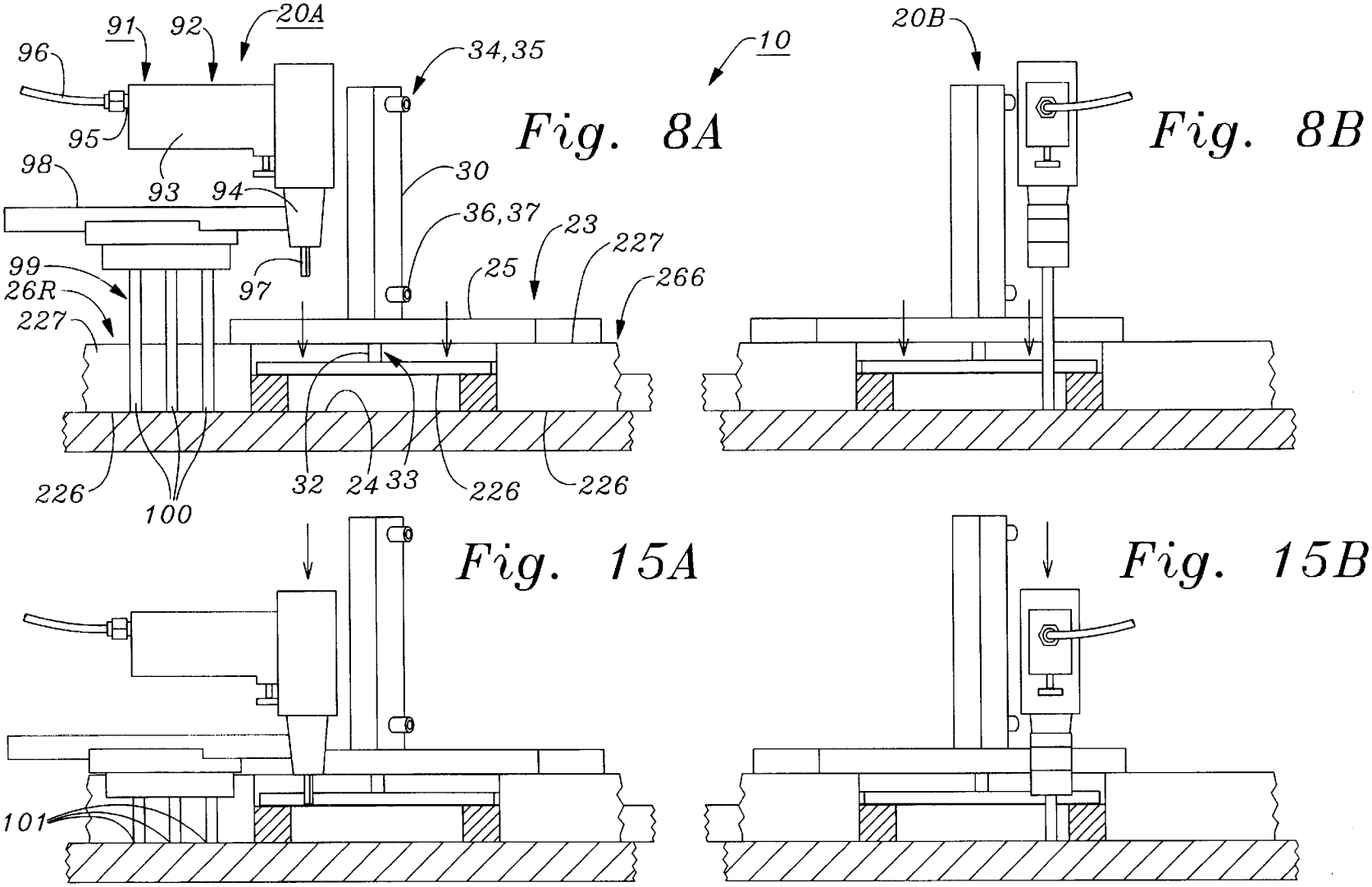
FIGS. 8A, 8B are a segmented oblique transverse sectional view of the apparatus of of FIG. 7, showing clamp bars of the left and right installation mechanisms brought down into compressive contact with the upper surface of the frame at left and right corners thereof.
FIGS. 15A, 15B are segmented transverse sectional views of the apparatus of FIG. 7, showing staplers thereof in active, downward positions to insert staples.

Referring still to FIGS. 1 and 8, it may be seen that each corner protector installation mechanism 20 includes a mechanism for fastening corner protectors 40 onto a picture frame, such as an automatic stapler mechanism 91, for stapling a corner protector 40 which has been folded around the corner of a picture frame. As shown in FIG. 1, stapler mechanism 91 includes a pneumatic stapler gun 92 such as a Josef Kohlberg, Model 680-6-46, which has a horizontally elongated body 93, a front vertically oriented staple-inserting head 94, and a rear air inlet port 95. Stapler gun 92 has an internal pneumatic actuator mechanism (not shown) which causes a jaw 97 at the lower end of stapler gun head 94 to eject a staple forcibly outwards from the jaw into an object contacted by the jaw, when pressurized air is supplied through air supply hose 96 to air inlet port 95 of the stapler gun, manufactured by Josef Kohlberg. Box 126, HJO, Sweden.

As may be seen best by referring to FIGS. 1 and 6, stapler mechanism 91 includes an adjustable support structure 98 for holding and supporting at an adjustable longitudinal distance, or throat depth, jaw 97 of stapler gun 92 relative to a picture frame held in clamp jig 23.

Support structure 98 is mounted on the upper end of a compressor/elevator actuator mechanism 99 which lowers stapler gun 92 to force jaw 97 into compressive contact with a corner protector-covered picture frame corner to insert a staple therein, and raises the jaw to an upper rest position upon completion of the stapling operation.

As may be seen best by referring to FIGS. 1 and 2, compressor/elevator actuator 99 mechanism of stapler mechanism 91 includes a pair of vertically disposed, laterally spaced apart support rods 100 fastened at the upper ends thereof to the lower portion of stapler gun support structure 98. Support rods 100 are vertically slidably supported in sleeve bearings 101 located below an elongated rectangular base plate 102. Base plate 102 is fastened to a structural member 103 within enclosure 21, and is located below a similarly-shaped aperture 104 through work table 22.

Referring now to FIGS. 1–6, corner protector apparatus 20 may be seen to include a pair of corner flap folder actuators 120L and 120R located on the left and right sides, respectively, of a longitudinal center line of work table 22 of the apparatus. As shown in FIG. 1, flap folder actuators 120L and 120R are located longitudinally inwards of clamping jig 23, in a location that places the actuators adjacent to the sides of a frame inserted inwardly under clamp bar 28 of clamping jig 23. Flap folder actuators 120L and 120R are identical in structure and function. Therefore, in the ensuing description, the flap folder actuators will be referred to generally without a subscript.

Figure 11:
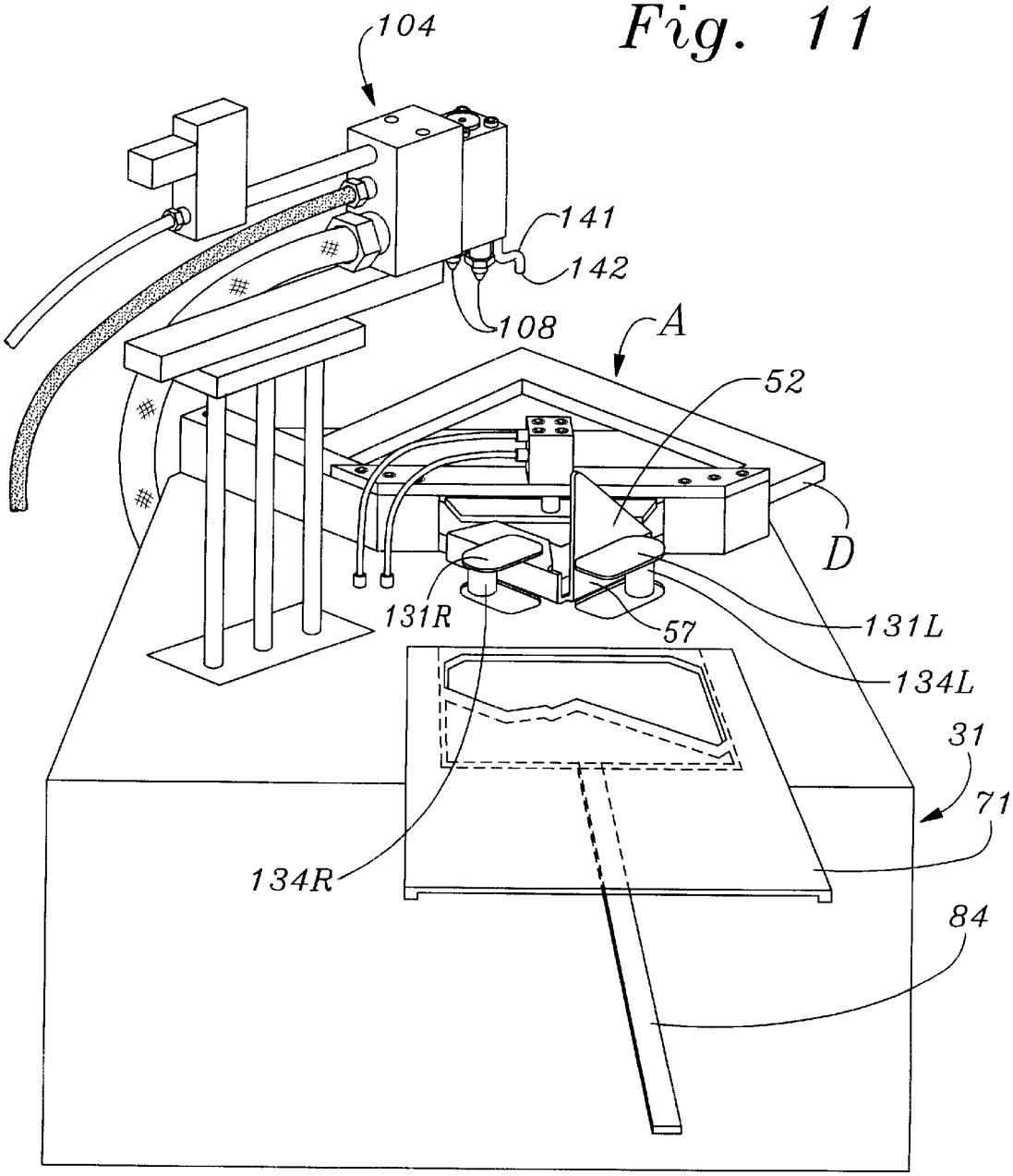
FIG. 11 is a fragmentary rear perspective view of the left-hand mechanism of the apparatus of FIG. 1, disposed as shown in FIG. 10.

As shown in FIGS. 1 and 11, each flap folder 120, such as left-hand folder actuator 120L, may be seen to include a flat, rectangularly-shaped flap folder arm 121 which fits into a complementarily shaped recess 119 provided in upper surface 24 of work table 22, flush with the upper surface. Arm 121 is oriented with a long, inner longitudinal edge 122 thereof parallel and adjacent to a side of a picture frame protruding diagonally inwardly from beneath clamp bar 28 of clamping jig 23.

Each flap holder arm 121 is mounted on the upper transversely disposed horizontal end all 123 of a vertically disposed, cylindrically-shaped support post 124. Also, each corner protector installation mechanism 20 includes a linear actuator for elevating supporting post 124 along its longitudinal axis, to thereby elevate flap folder arm 121 attached to the upper end of the support post upwardly from its rest position recessed in upper surface 24 of work table 21, and a rotary actuator for reciprocally rotating elevator support post 124 about its longitudinal axis, to thereby rotate the flap folder arm ninety degrees away from and back to its rest position, where the linear actuator retracts the flap folder arm into recess 119.

Each corner protector installation mechanism 20 according to the present invention also includes sensor means which provides a signal indicating that a corner of a picture frame has been fully inserted into clamping jig 23, with the moldings adjacent the corner parallel to and proximate inner vertical wall surfaces 228R, 228L of guide plates 26R, 26L.

Various types of proximity or optical sensors suitable for that purpose are well known to those skilled in the art. In an example embodiment of apparatus 10 tested by the present inventor, each sensor 160 consisted of a UZJ-111, fixed-focus type micro-photo sensor, manufactured by Matsushita Electric Works, Ltd., Automation Controls Group, 1048 Kadoma, Osaka 571, Japan. That sensor contains an infrared light emitting diode and phototransistor arranged within a circuit module with their optical axes generally parallel, and their respective exit and entrance pupils adjacent each other behind an infrared window comprising the outer face of the module. When a surface such as the outer surface of a picture frame molding is positioned within about 5 mm±2.5 mm of the outer face of the sensor, an output transistor within the sensor is turned on, providing a logic TRUE current through a load resistor connected in series with a collector supply voltage, and the emitter and collector output terminals of the sensor.

Figure 7:
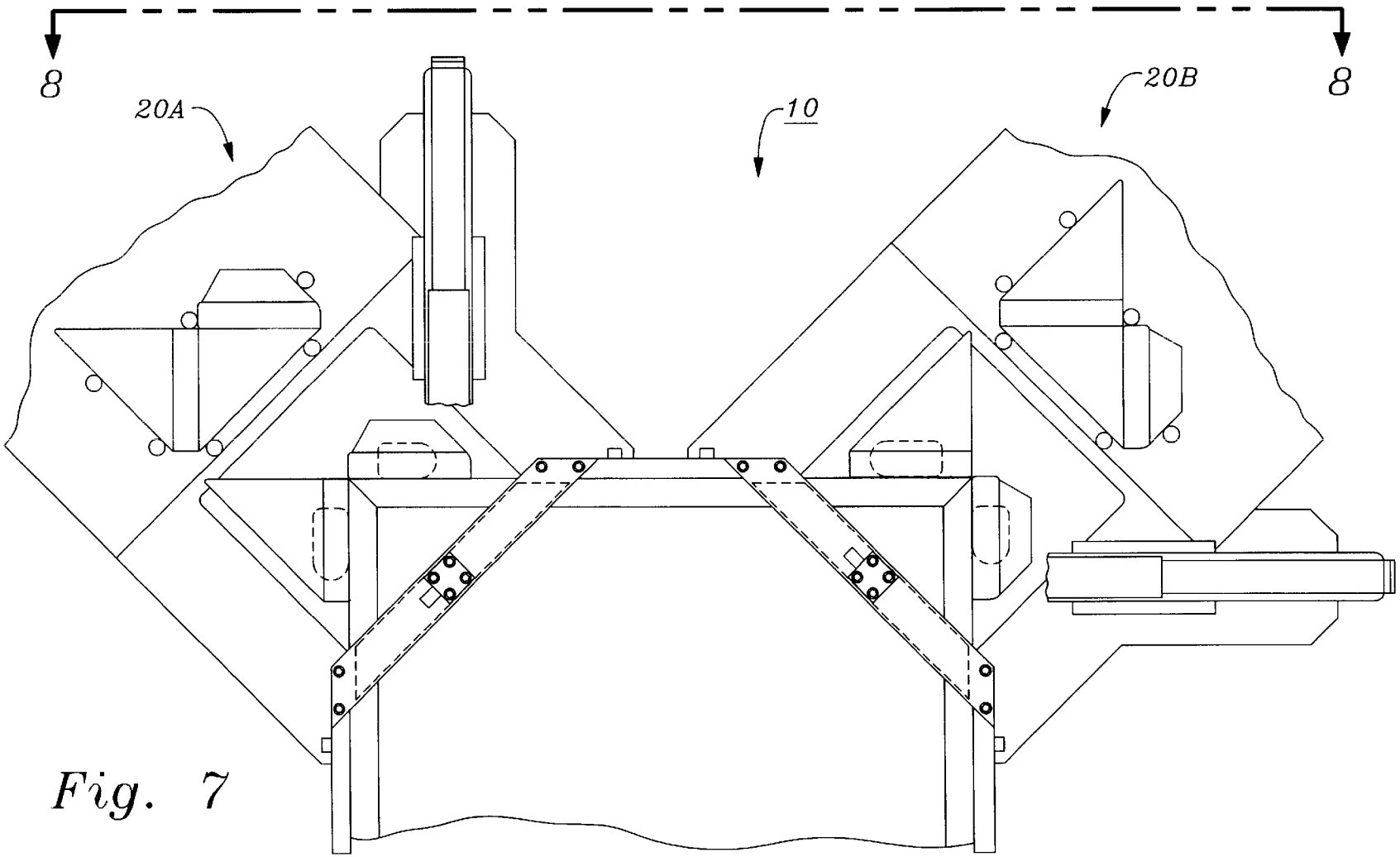
FIG. 7 is an upper plan view similar to that of FIG. 6, but showing a picture frame fully inserted into the apparatus, thereby producing sensor signals which initiate operation of the apparatus.

As shown in FIGS. 1 and 2, a pair of sensors 160 of the type described above with their outer faces installed in guide plates 26R, 26L, flush with the inner surfaces 228R, 228L of guide plates 26R, 26L, respectively, near the inner transverse vertical end walls 161R, 161L thereof, and near upper surface 24 of work table 22. Each sensor 160 produces a logic TRUE signal when a frame molding is parallel to and a predetermined distance from inner surface 228R, 228L adjacent the outer face of the sensor. Moreover, apparatus 10 includes an electronic AND circuit 162 for logically ANDING signals from the output terminals of all four sensors 160 of left and right corner protector installation mechanisms 20A and 20B, e.g., sensors 160AL, 160AR, 160BL, 160BR. The output signal from the AND circuit is false when any of the 4 sensors 160 outputs a false signal, indicating that a picture frame molding near that sensor is not substantially close to and parallel to the sensor, such as shown in FIG. 6. However, when the two adjacent corners of a frame have been fully inserted into and properly aligned with clamping jigs 23 of left and right corner protector installation mechanisms 20A, 20B of apparatus 10, as shown in FIG. 7, the logical AND circuit produces a TRUE output signal which initiates simultaneous operation of each corner protector installation mechanism. Electronic circuitry for performing the foregoing functions is well known to those skilled in the art, and therefore need not be described in further detail here. For example, such circuitry can be implemented in a Programmable Logic Controller, PLC, or a general purpose microprocessor or micro controller.

OPERATION OF THE INVENTION

In response to a TRUE output signal from AND circuit 162 when all four sensors 160AR, 160AL, 160BR, 160BL produce TRUE output signals, Programmable Logic Controller (PLC) 113 issues in sequence drive signals to the various actuators of both corner protector installer mechanisms 20A, 20B of apparatus 10 according to the present invention, as follows:

1. Vertical stacks of corner protector preforms 40 are loaded into bores 68 between guide rods 67 of feeder mechanisms 60 of both left and right tandem installer mechanism 20A, 20B.

2. Power is turned on and PLC 113 resets and checks both mechanisms 20A, 20B of apparatus 10, readying the PLC for outputting sequential drive signal commands to the various actuators of the apparatus. A program for the operational sequence of apparatus 10 is stored in electronic memory means in PLC 113. This program can be executed via an internal or external computer.

3. Actuator cylinders 82 of feeder mechanism 60 in each installer mechanism 20A, 20B are actuated to reciprocate piston rod 84, thereby moving an individual corrugated corner protector blank preform 40 forward into position below clamp bar 28 of each installer mechanism. (FIG. 5)

4. Adjacent corners C1, C2 of a picture frame A are inserted into position beneath clamp bars 28 and over blanks 40 of left and right installer mechanisms 20A, 20B, respectively. (FIG. 6)

5. Frame A is positioned relative to apparatus 10 so that corners C1, C2 of the frame are fully inserted into clamping jigs 23 of mechanisms 20A, 20B, respectively. (FIG. 7)

6. Sensors 160AL, 160AR, 160BL, 160BR of installer mechanisms 20A, 20B output TRUE signals, causing AND circuit 162 to output a TRUE signal, in turn causing PLC 113 to simultaneously issue drive signals to both installer mechanisms, as follows: (FIG. 7)

7. Hold down clamp bars 28 of clamping jigs 23 of mechanisms 20A, 20B are forced downward onto the channels of frame A defining corners C1, C2, respectively. (FIG. 8)

Figure 9:
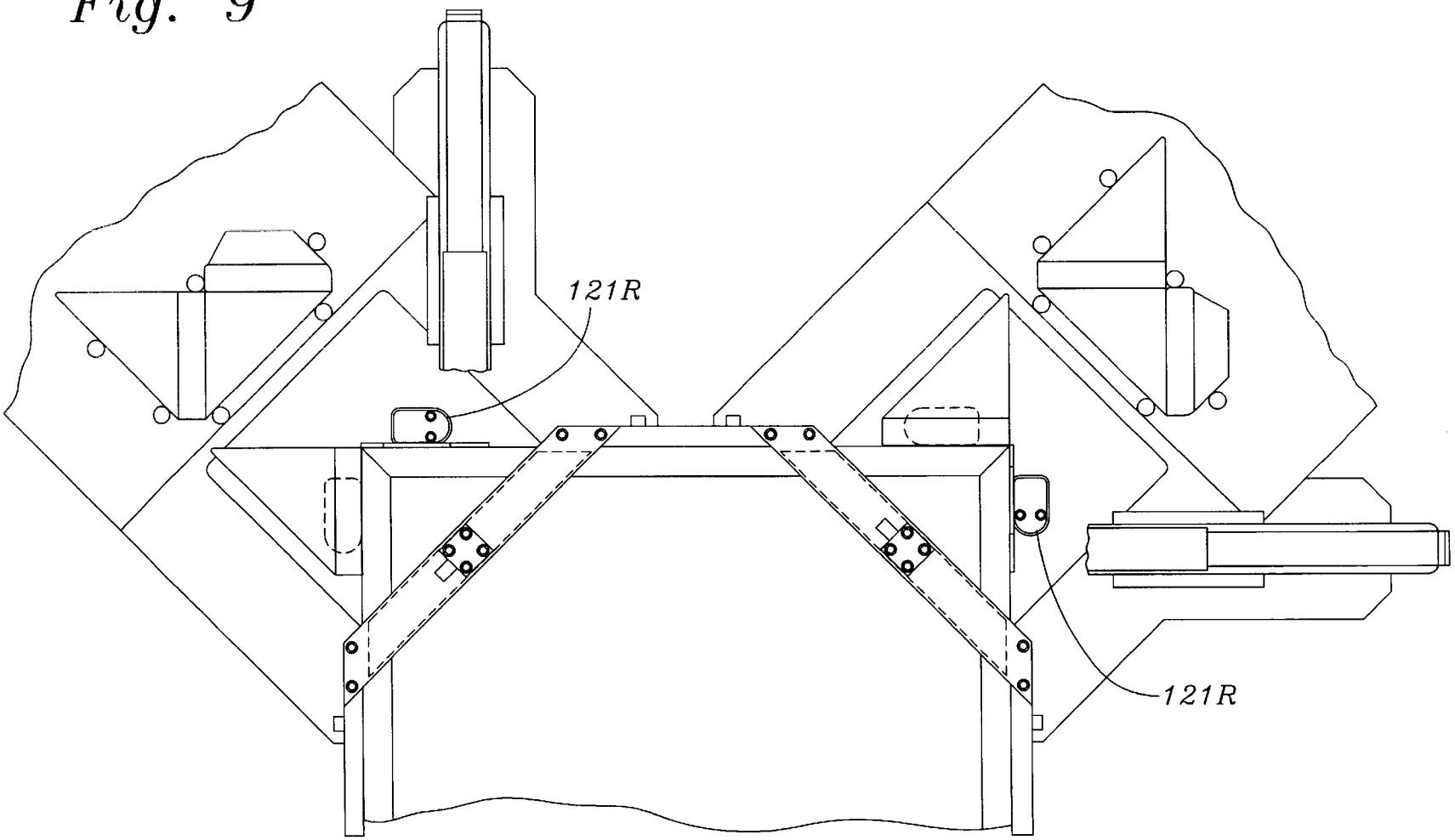
FIG. 9 is a view similar to that of FIG. 7, but showing a first, corner flap actuator of each of the two installation mechanisms in an upwardly actuated position.

8. Blank preforms 40 under each corner C1, C2 of frame A are automatically manipulated as follows: First, rectangular cover flap 50 and securement flap 51 of each preform 40 are bent inwardly in unison by elevating left-hand flap folder arm 121L of each mechanism 20A, 20B from its recess 119L, with the flap folder arm in its clockwise position. (FIG. 9)

Figure 10:
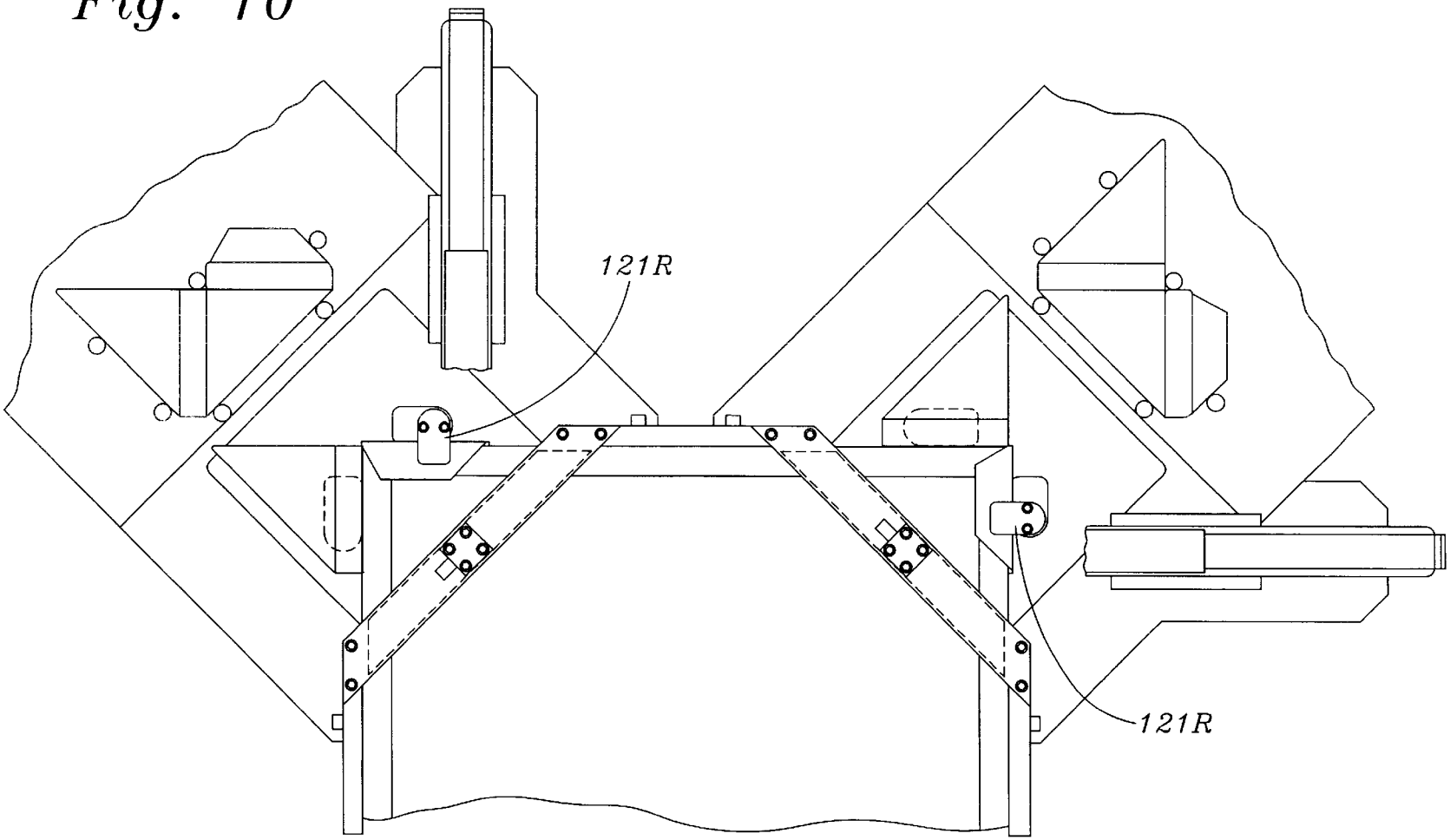
FIG. 10 is a view similar to that of FIG. 9, but showing a fold-effecting arm of the first corner flap actuator of each of the two left and right mechanisms rotated to contact and fold down a securement flap of the corner protector preform into a position overlying the picture frame.

9. Securement flap 51 of each preform 40 is bent inwardly and downwardly over a left frame channel by rotating left-hand flap folder arm 121L counterclockwise. (FIG. 10)

10. Right-hand triangular cover flap 42 and spine flap 47 of each preform 40 are bent as a unit into a vertically disposed position by extending right-hand flap folder arm 142R upwardly from recess 119R. (FIG. 11)

11. Cover flap 42 of each preform 40 is bent inwardly and downwardly over a right-hand frame channel by rotating flap folder arm 124R ninety degrees clockwise. (FIG. 11)

Figure 12:
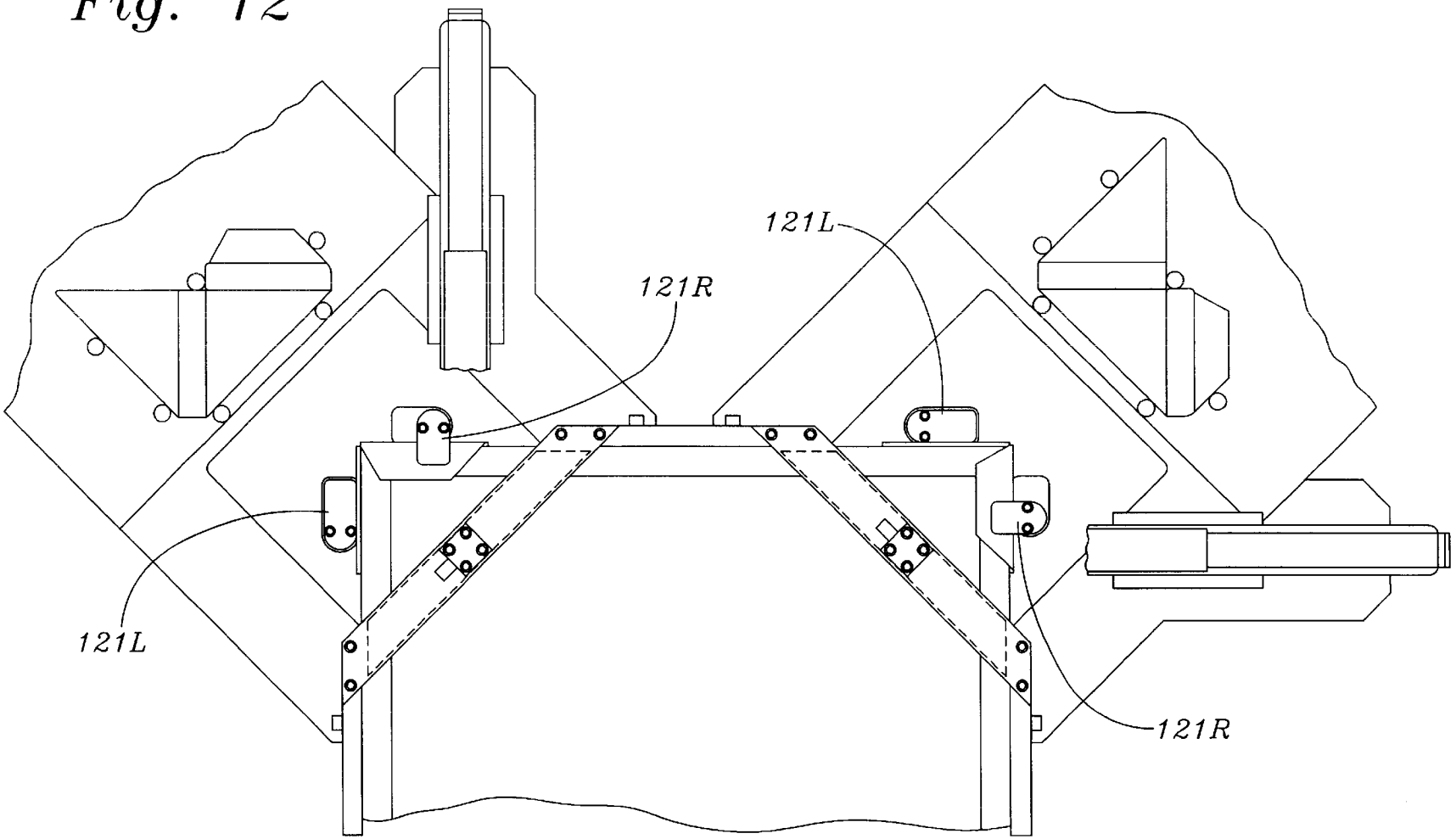
FIG. 12 is a view similar to that of FIG. 10, but showing a second corner flap actuator of each mechanism of the apparatus in an upwardly actuated position.

12. Left flap folder arm 121L is rotated ninety degrees clockwise to its angular rest position, and retracted downwardly into recess 119L to its vertical rest position. (FIG. 12)

Figure 13:
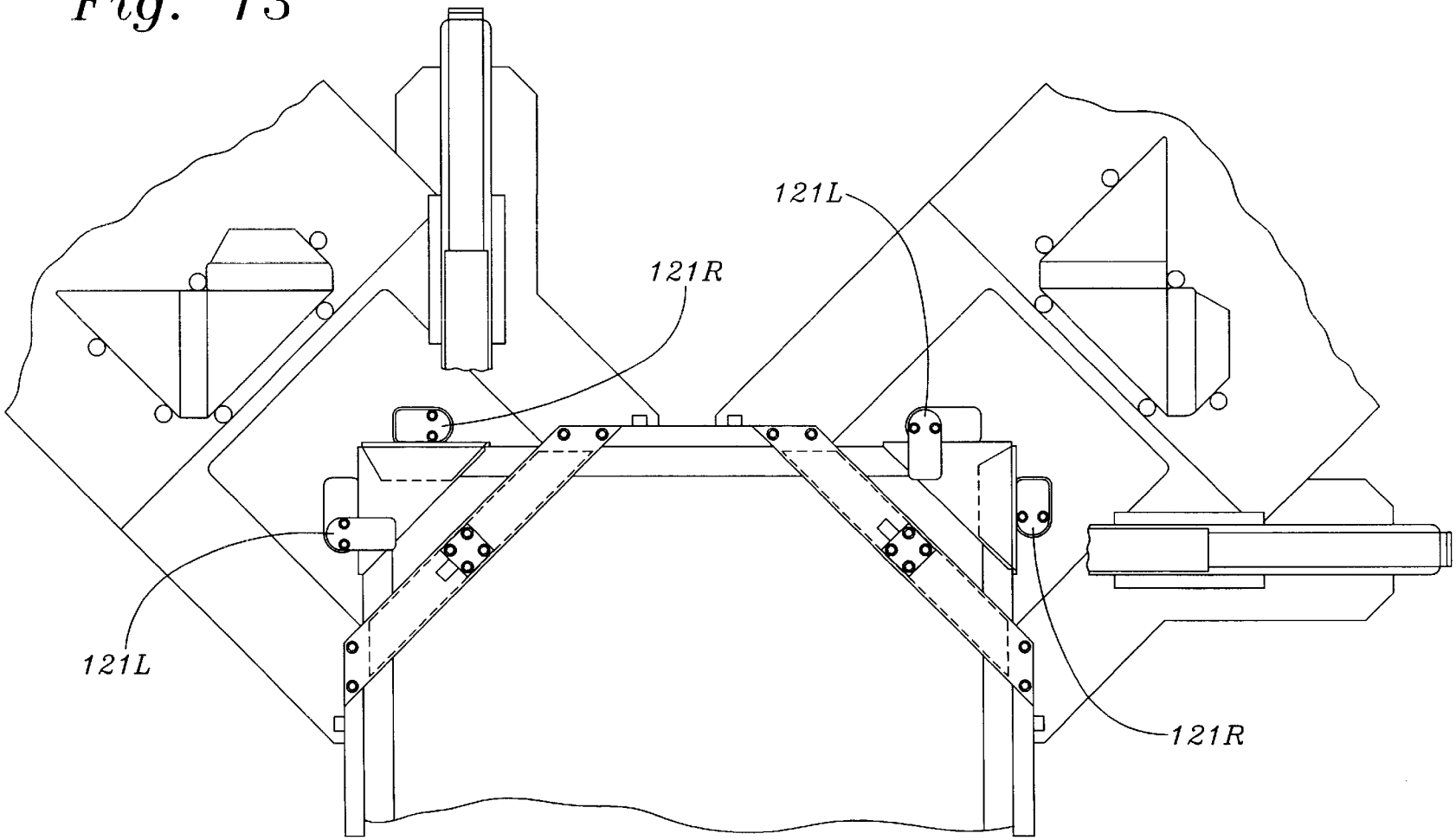
FIG. 13 is a view similar to that of FIG. 11, but showing a fold effecting arm of the second lower flap actuator of each of the two installation mechanisms rotated to contact and fold down a second triangular cover flap of the corner protector preform into a position overlying the securement flap of the corner protector preform.
Figure 14:
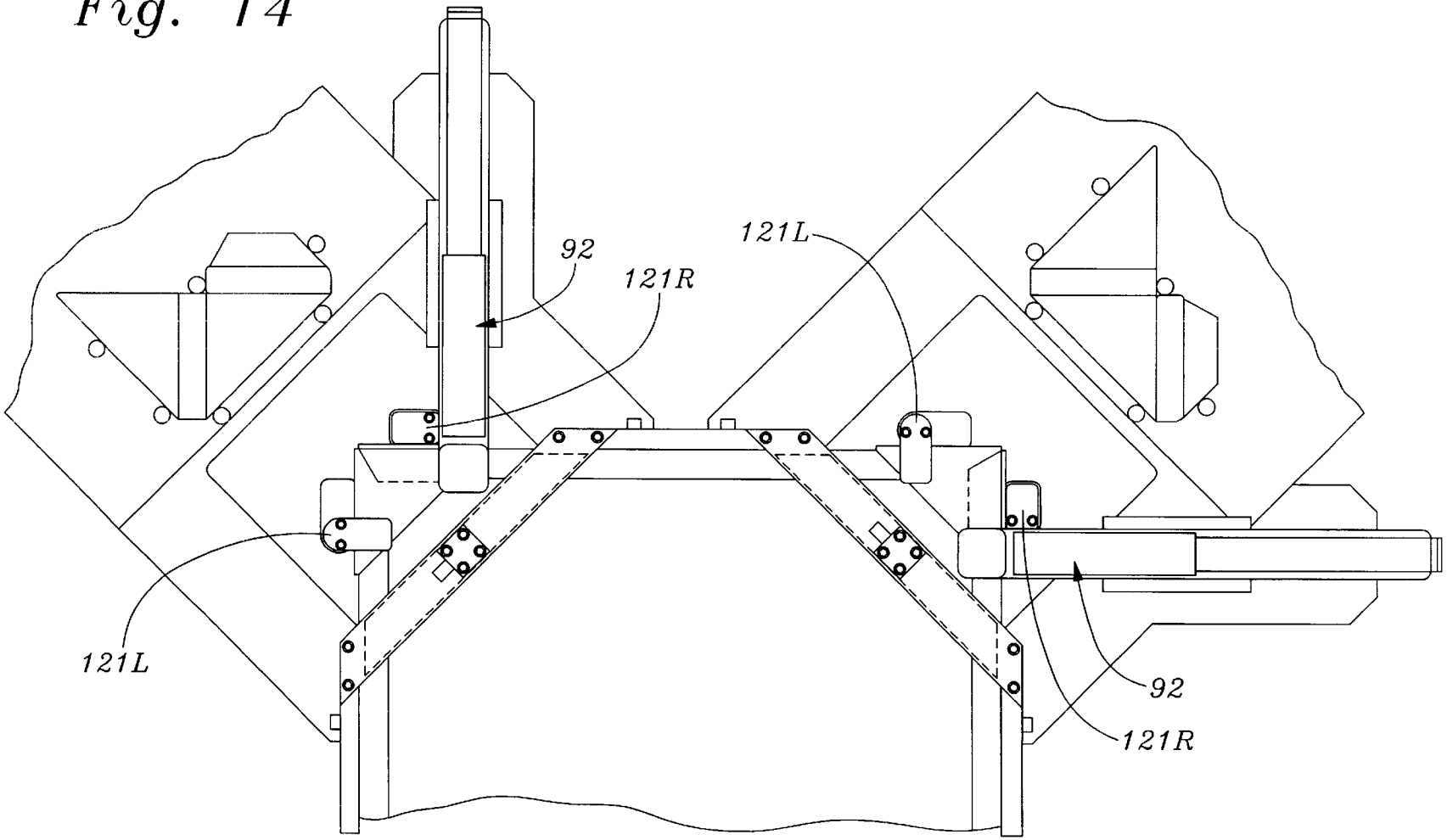
FIG. 14 is a view similar to that of FIG. 12, but showing the fold-effecting arm of the first corner flap actuator of each mechanism rotated back into an inactive, home position, and showing a stapler comprising part of each mechanism inserting a staple through the second triangular cover flap and securement flap and into the picture frame.

13. Staple gun 92 of each mechanism 20A, 20B is lowered toward frame A. Each staple gun 92 has an automatic firing trigger that discharges a staple through cover flap 42, securement flap 51, and frame A, upon compressive contact of the staple gun with the upper surface of cover flap 42. (FIG. 13)

14. Right flap folder arm 121R of each mechanism 20A, 20B is rotated ninety degrees couterclockwise to its angular rest position. (FIG. 12)

15. Right flap folder arm 121R of each mechanism 20A, 20B is retracted downwardly into recess 119R to its vertical rest position. (FIG. 11)

16. Hold down clamp bars 28 of clamping jigs 23 of each mechanism 20A, 20B are retracted vertically upwards to their rest positions, unclamping corners C1, C2 of frame A.

17. Frame A is retracted from apparatus 10, disengaging corners C1, C2 from clamping jig 23.

18. Frame A is rotated one hundred and eighty degrees in a horizontal plane, and steps 4–16 repeated to attach corner protectors 40 to the remaining two corners C3, C4 of frame A.

19. Step 17 is repeated.

What is claimed is:

1. A method for attaching in tandem protective covers to a plurality of corners of a frame, each of said corners being defined by the intersection at a dihedral angle of two adjacent elongated intersecting channel members comprising two adjacent sides of said frame, said method comprising a. placing said frame corners in a predetermined relationship to a plurality of spaced apart corner protector preforms, b. generating a sensing signal in response to all of said frame corners being simultaneously positioned in a predetermined alignment with said performs, and c. automatically and simultaneously fastening each of said performs to a separate corner of said frame in response to said sensing signal.

2. The method of claim 1 wherein each of said corner protector preforms is further defined as comprising a thin sheet of flexible material, said sheet being foldable into a plurality of flaps.

3. The method of claim 2 further including the step of folding each of said preforms over an adjacent corner of said frame in response to said sensing.

4. The method of claim 1 wherein said plurality of corners of said frame is further defined as two.

5. The method of claim 4 wherein each of said toner protector preforms is further defined as comprising a thin sheet of flexible material, said sheet being foldable into a plurality of flaps.

6. The method of claim 5 further including the step of folding each of said preforms over an adjacent corner of said frame in response to said sensing.

7. The method of claim 1 wherein each of said corner protector preforms is further defined as comprising a thin sheet of flexible material, said sheet being foldable into a plurality of flaps including:

(i) a vertically elongated rectangular spine flap having a width approximately equal to the thickness of said intersecting channel members, (ii) a first generally right triangularly-shaped, lower cover flap having a vertical side coextensive with a first vertical longitudinal side edge wall of said spine flap, a base collinear and coextensive with the lower horizontal lateral base edge wall of said spine flap, and a hypotenuse which intersects the upper horizontal lateral edge wall of said spine flap, (iii) a horizontally elongated, rectangularly-shaped side cover flap depending downwardly from said base of said first, lower cover flap, said side cover flap having a height approximately equal to the thickness of said intersecting channel members of said frame, (iv) a horizontally elongated securement flap, depending downwardly from said first side cover flap, and (v) a second, generally right triangularly-shaped, upper cover flap shaped similarly to said first, lower flap and joined to a second vertical longitudinal side edge wall of said spine flap in a laterally opposed location to said first, lower cover flap, the hypotenuse of said second, upper cover flap being inclined to said hypotenuse of said first, lower cover flap at an angle substantially equal to said dihedral angle between said adjacent intersecting channel members of said frame.

8. The method of claim 7 further including the steps of:

a. folding upwards from the plane of said first, lower cover flap of said corner protector preform said first side cover flap and said securement flap adjacent a side wall of said first channel member, b. folding said securement flap perpendicularly inwards from said first side cover flap to overlie the upper wall surface of said first channel member, c. folding upwards from the plane of said corner protector preform said spline flap and said second, upper cover flap adjacent a side wall of said second channel member, and d. folding said second triangular-shaped cover flap perpendicularly inwards along said junction line between said second longitudinal edge wall of said spine and said second triangular cover flap to overlie said securement flap and the upper wall surface of said second channel member.

9. The method of claim 8 wherein said fastening step is further defined as including fastening said upper cover flap to said securement flap.

10. The method of claim 9 wherein said plurality of corners of said frame is further defined as two.

11. The method of claim 10 wherein the upper surface of said corner protector preform which is located at said first longitudinal side edge of said spine flap of said corner protector preform coextensive with said side of said first, lower triangular cover flap is further defined as being scored to facilitate folding of said first, lower triangular cover flap relative to said spine flap.

12. The method of claim 11 wherein the upper surface of said corner protector preform on which is located said second longitudinal side edge wall of said spine flap of said corner protector is further defined as being scored to facilitate folding of said second, upper triangular cover flap relative to said spine flap.

13. The method of claim 12 wherein the upper surface of said corner protector preform on which is located the intersection between said first, lower triangular cover flap and said first side cover flap further defined as being scored to facilitate folding of said side cover flap relative to said first, lower triangular cover flap.

14. The method of claim 13 wherein the upper surface of said corner protector preform on which is located the intersection between said securement flap and said first side cover flap is further defined as being scored to facilitate folding of said securement flap relative to said side cover flap.

15. The method of claim 10 wherein said angle between the hypotenuses of said first and second triangular cover flaps is further defined as being substantially a right angle.

16. An apparatus for attaching protective covers to a plurality of corners of a frame, each of said corners being defined by the intersection at a dihedral angle of two adjacent elongated intersecting channel members comprising two adjacent sides of said frame, said apparatus comprising:

a. support means for supporting a plurality of individual corner protector preforms at a predetermined spaced apart relationship corresponding to spacing between said plurality of corners of said frame, b. sensing means for producing a sensing signal when said frame has been positioned in a predetermined relationship to said individual corner preforms, and c. fastening means responsive to said sensing signal from said sensor means in fastening each of said plurality of preforms to an adjacent one of said plurality of corners.

17. The apparatus of claim 16 wherein each of said corner protector preforms is further defined as comprising a thin sheet of flexible material, said sheet being foldable into a plurality of flaps.

18. The apparatus of claim 17 further including means for folding each of said preforms over an adjacent corner of said frame in response to said sensing signal from said sensing means.

19. The apparatus of claim 16 wherein said plurality of corners of said frame is further defined as two.

20. The apparatus of claim 19 wherein each of said corner protector preforms is further defined as comprising a thin sheet of flexible material, said sheet being foldable into a plurality of flaps.

21. The apparatus of claim 20 further including means for folding each of said preforms over an adjacent corners of said frame in response to said sensing signal.

22. The apparatus of claim 16 wherein each of said corner protector preforms is further defined as comprising a thin sheet of flexible material, said sheet being foldable into a plurality of flaps including:

(i) a vertically elongated rectangular spine flap having a width approximately equal to the thickness of said intersecting channel members, (ii) a first generally right triangularly-shaped, lower cover flap having a vertical side coextensive with a first vertical longitudinal side edge wall of said spine flap, a base collinear and coextensive with the lower horizontal lateral base edge wall of said spine flap, and a hypotenuse which intersects the upper horizontal lateral edge wall of said spine flap, (iii) a horizontally elongated, rectangularly-shaped side cover flap depending downwardly from said base of said first, lower cover flap, said side cover flap having a height approximately equal to the thickness of said intersecting channel members of said frame, (iv) a horizontally elongated securement flap, depending downwardly from said first side corner flap, and (v) a second, generally right triangularly-shaped, upper cover flap shaped similarly to said first, lower flap and joined to a second vertical longitudinal side edge wall of said spine flap in a laterally opposed location to said first, lower cover flap, the hypotenuse of said second, upper cover flap being inclined to said hypotenuse of said first, lower cover flap at an angle substantially equal to said dihedral angle between said adjacent intersecting channel members of said frame.

23. The apparatus of claim 22 further including folding means for folding each of said preforms over an adjacent corner of said frame in response to said sensor signal, said folding means comprising:

a. means for bending upwardly from said preform a first side cover portion adjacent to a side of a first of said intersecting channel members, b. means for bending inwardly from said first side cover portion a securement portion which overlies an upper side wall of said first one of said frame channel members, c. means for being upwardly from said preform a second side cover portion adjacent to a side of said second intersecting channel member, and d. means for bending inwardly from said second side cover portion a second cover flap portion which overlies said securement portion.

24. The apparatus of claim 23 wherein said means for bending adjacent a side wall of a first one of said pair of adjacent channel members a first side cover portion of said preform is further defined as being a first flap folder arm attached to a first end of a first vertically upwardly movable linear actuator, said arm being located in a first recess in the upper surface of a worktable, below said preform, whereby upward extension motion of said first linear actuator forces said first portion of said preform to bend upwardly from said worktable surface.

25. The apparatus of claim 24 wherein said means for bending perpendicularly inwardly from said first side cover portion of said preform a securement portion overlying said frame channel member is further defined as being first rotary actuator means coupled to said first flap folder arm, said first rotary actuator means being effective in rotating said first flap folder arm from an elevated position vertically aligned with said first arm recess to a position overlying said first channel member, thereby bending over from said first side cover portion a securement flap.

26. The apparatus of claim 25 wherein said means for bending adjacent a side wall of a second one of said pair of adjacent channel members a second side cover portion of said preform comprising a spine portion and a second triangular cover flap portion is further defined as being a second flap folder arm attached to a first, upper end of a second vertically upwardly movable linear actuator, said arm being located in a second recess in said upper surface of said worktable, below said preform, whereby upward extensional motion of said second linear actuator forces said second side portion of said preform to bend upwardly from said worktable surface.

27. The apparatus of claim 26 wherein said means for bending said second triangularly-shaped upper cover flap perpendicularly inwards from said spine flap is further defined as being second rotary actuator means coupled to said second flap folder arm, said second rotary actuator means being effective in rotating said second flap folder arm from an elevated position vertically aligned with said second arm recess to a position overlying said channel member.

28. An apparatus for folding a plurality of corner protector preforms around corners of a frame, each of said corners being defined by the intersection at a dihedral angle of two adjacent elongated intersecting channel members comprising two adjacent sides of said frame, each of said corner protector preforms comprising a thin sheet of flexible material foldable into a plurality of flaps, said apparatus comprising:

a. means for supporting a plurality of corner protector installation mechanisms spaced apart from one another at predetermined distances relative to corners of said frame, b. sensing means for producing a sensing signal when each of said corners of said frame have been simultaneously positioned in a predetermined relationship to said installation mechanisms, and c. command signal generating means responsive to said sensing signal effective in initiating automatic operation of each of said installation mechanisms to thereby fasten separate ones of said corner protector preforms to separate ones of said corners of said frame.

29. The apparatus of claim 28 wherein each of said preforms is further defined as including:

(i) a vertically elongated rectangular spine flap having a width approximately equal to the thickness of said intersecting channel members, (ii) a first generally right triangularly-shaped, lower face cover flap having a vertical side coextensive with a first vertical longitudinal side edge wall of said spine flap, a base collinear and coextensive with the lower lateral base edge wall of said spine flap, and a hypotenuse which intersects the upper horizontal lateral edge wall of said spine flap, (iii) a horizontally elongated, rectangularly-shaped first cover flap which depends downwardly from said base of said first, lower face cover flap, said side cover flap having a height approximately equal to the thickness of said intersecting channel members of said frame, and depending downwardly from said side cover flap, (iv) a horizontally elongated securement flap depending downwardly from said first side cover flap, and (v) a second, generally right triangularly-shaped upper face cover flap shaped similarly to said lower face cover flap and joined to a second vertical longitudinal side edge wall of said spine flap in a laterally opposed location to said lower face cover flap, the hypotenuse of said upper face cover flap section being inclined to said hypotenuse of said lower face cover flap at an angle substantially equal to said dihedral angle between said adjacent intersecting channel members of said frame.

30. The apparatus of claim 29 wherein each of said mechanisms is further defined as including:

a. a support means for supporting said preform and a corner of said frame overlying said lower cover flap of said preform, b. means for bending upwardly and adjacent a first intersecting side channel member of said frame from the plane of said preform and said lower face cover flap, said side cover flap and said securement flap, c. means for bending inwardly from said first said cover flap said securement flap to a location overlying said first side channel member of said frame, d. means for bending upwardly adjacent said second intersecting channel member of said frame from the plane of said preform and said lower face cover flap said spine flap and said upper face cover flap, e. means for bending inwardly from said spine flap said upper face cover flap to a location overlying said second channel member of said frame and said securement flap, and f. means for securing said preform in said folded disposition to said frame.

31. The apparatus of claim 30 further including means for releasably securing said frame to said supporting means of said apparatus.

32. The apparatus of claim 31 wherein said means for releasably securing said frame to said supporting means of said apparatus is further defined as being a clamping bar.

33. The apparatus of claim 32 wherein said clamping bar is further defined as being perpendicularly actuatable relative to said support frame.

34. The apparatus of claim 32 further including guide means for slidably receiving and holding said frame in a fixed horizontal disposition relative to said support means.

35. The apparatus of claim 34 wherein said guide means is further defined as comprising in combination a pair of elongated plates disposed obliquely to one another and having inner facing obliquely disposed wall surfaces inclined relative to one another at said dihedral angle of said frame, said plates having between converging longitudinal ends thereof a laterally disposed space adapted to insertably receive said corner of said frame.

36. The apparatus of claim 30 wherein said support means is further defined as being a tabular body having a generally flat upper work surface.

37. The apparatus of claim 30 wherein said means for bending said first, lower face cover flap and said securement flap from the plane of said lower face cover flap is further defined as comprising in combination a first flap folder arm having a flat wall surface disposed parallel to and spaced outwardly apart from said first frame channel member, and first linear actuator means for elevating said first flap folder arm vertically upwardly from a first recessed portion of said tabular body, flush with said upper work surface.

38. The apparatus of claim 37 wherein said means for bending said securement flap inwardly from said first side cover flap is further defined as first rotary actuator means coupled to said first linear actuator means, said first rotary actuator means being effective in rotating said inner wall of said first flap folder arm inwardly towards said first frame channel member.

39. The apparatus of claim 38 wherein said means for bending said spine flap and said upper face cover flap of said preform is further defined as comprising in combination a second flap folder arm having a flat inner wall surface disposed parallel to and spaced outwardly apart from said second frame channel member and second linear actuator means for elevating said second flap folder arm vertically upwardly from a second recessed portion of said tabular body, flush with said upper work surface.

40. The apparatus of claim 39 wherein said means for bending said upper face cover flap from said spine flap is further defined as second rotary actuator means coupled to said second linear actuator means, said second rotary actuator means being effective in rotating said inner wall of said second flap folder arm inwardly towards said second frame channel member.

41. The apparatus of claim 40 wherein said means for securing said preform in said folder over disposition relative to said frame corner is further defined as comprising a staple gun vertically actuatable relative to said work table surface.

* * * * *